US008474160B1

(12) United States Patent
Thomas et al.

(10) Patent No.: US 8,474,160 B1
(45) Date of Patent: Jul. 2, 2013

(54) CENTER PIN SUPPORT FOR A DRAGLINE EXCAVATING MACHINE

(75) Inventors: Marty W. Thomas, Hallsville, TX (US); James Alan Ehret, Norwalk, OH (US)

(73) Assignee: Warfab Industries, Inc., Hallsville, TX (US)

( * ) Notice: Subject to any disclaimer, the term of this patent is extended or adjusted under 35 U.S.C. 154(b) by 0 days.

(21) Appl. No.: 13/317,353

(22) Filed: Oct. 17, 2011

(51) Int. Cl.
*E02F 3/58* (2006.01)

(52) U.S. Cl.
USPC ..... 37/397

(58) Field of Classification Search
USPC ..... 37/397, 394, 395
See application file for complete search history.

(56) References Cited

U.S. PATENT DOCUMENTS

| | | | | | |
|---|---|---|---|---|---|
| 2,049,653 | A | * | 8/1936 | Ljungkull | 212/175 |
| 2,144,760 | A | * | 1/1939 | Harnischfeger | 212/253 |
| 2,399,417 | A | * | 4/1946 | Wilson et al. | 180/8.5 |
| 2,408,378 | A | * | 10/1946 | Davenport et al. | 212/247 |
| 4,037,894 | A | * | 7/1977 | Sankey | 384/618 |
| 4,231,699 | A | * | 11/1980 | Thompson | 414/687 |
| 5,154,012 | A | | 10/1992 | Kallenberger | |
| 5,154,013 | A | | 10/1992 | Kallenberger | |
| 5,642,577 | A | * | 7/1997 | Kallenberger | 37/397 |
| 5,676,471 | A | | 10/1997 | Kallenberger et al. | |

* cited by examiner

*Primary Examiner* — Thomas B Will
*Assistant Examiner* — Joan D Misa
(74) *Attorney, Agent, or Firm* — Harpman & Harpman

(57) ABSTRACT

A center pivot pin support bearing assembly to provide rotatable center restraint for a dragline excavator machine. Multiple center pin bearing support fittings imparts stabilization and additional bearing wear surfaces for increased pin useful service life before replacement. An axially center pin bore receiving fitting is provided for longitudinal spaced multiple support fits combination with a center pin receiving stabilization base and fit.

7 Claims, 3 Drawing Sheets

CENTER PIN SUPPORT FOR A DRAGLINE EXCAVATING MACHINE

BACKGROUND OF THE INVENTION

1. Technical Field

This invention relates to dragline excavating machines which have a main support center pin assembly. Dragline excavation machines are supported on a central stabilization tub during excavating. As such, stress is imparted thereto by the shear weight of the machine and the excavating movements required during use. Such large machines are movable from location to location by use of a walking mechanism that lifts the entire machine up and forward repeatedly imparting increased stress and wear to the center pin and support structure as well as during use in which lateral forces are encountered and the machine pivots on the center pin support structure.

2. Description of Prior Art

Prior art support tubs and center pin assemblies can be seen in the following U.S. Pat. Nos. 5,154,012, 5,154,013, 5,676,471.

In U.S. Pat. No. 5,154,012 a support tub for a dragline excavating machine is described with a circular tracking ring support and a lifting stool assembly with a center pin lifting pin threadably secured within a bearing support frame.

U.S. Pat. No. 5,154,013 is a support tub for a dragline directed to a lifting stool with lifting pivot pin.

U.S. Pat. No. 5,676,471 claims a dragline excavator with improved thrust bearing assemblies support upper structure. A center pin connects the upper structure to the lower structure of the support. A perimeter annular rail with rollers provide for rotation of the structure thereabout.

SUMMARY OF THE INVENTION

A center pin support bearing fitting assembly to pivotally support and maintain a dragline structure on a center support tub during excavating and selectively while moving using a walking mechanism. The center pin support has multiple bearing bore configuration by adding an additional bore bearing support at the center pin base spaced in relation to the primary support bores within the support bearing fitting assembly within the center support tub frame of the dragline.

DETAILED DESCRIPTION OF THE INVENTION

Figure 1:
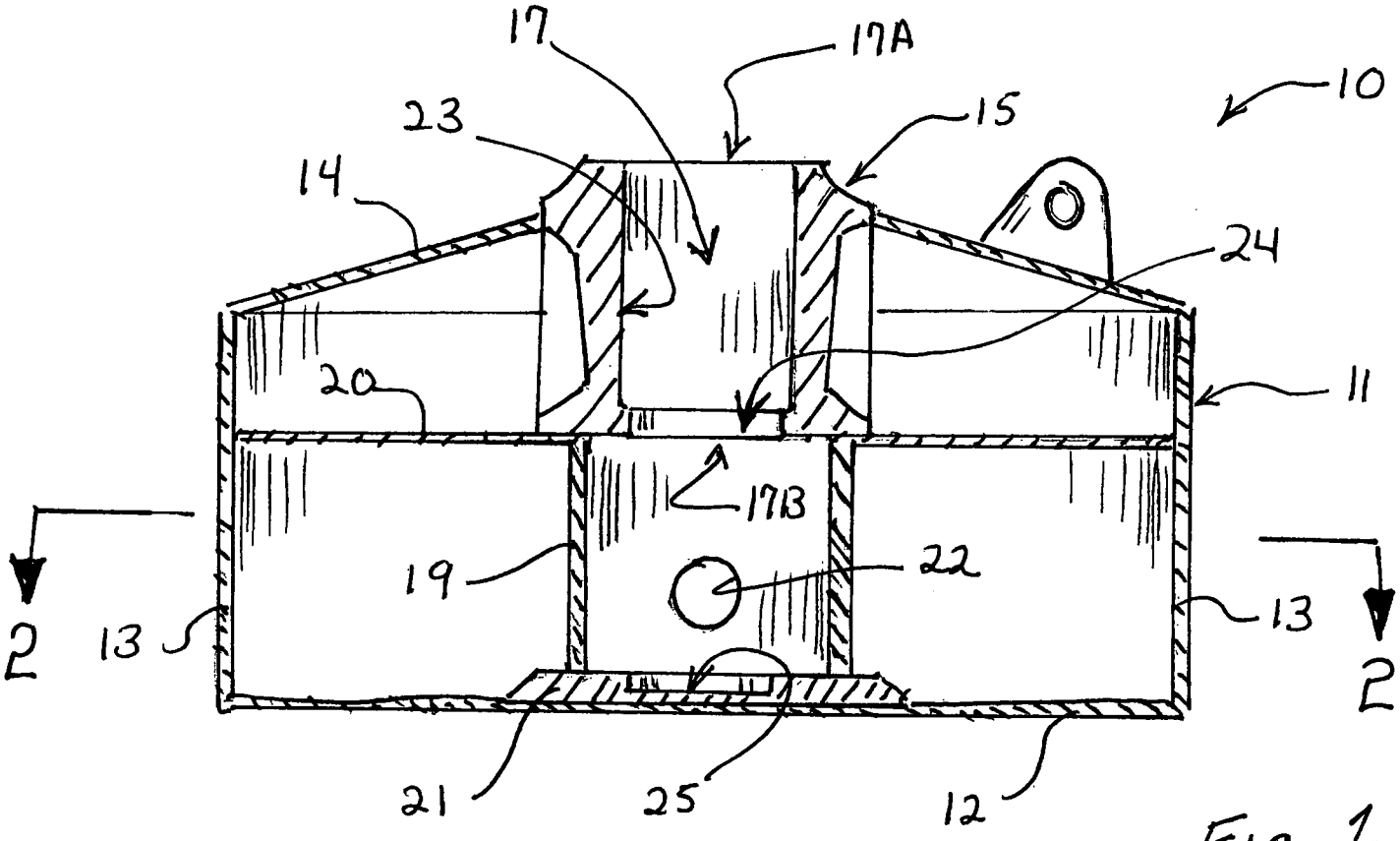
FIG. 1 is a cross-sectional view of a center pin support bearing fitting illustrating multiple bore support elements of the invention.
Figure 2:
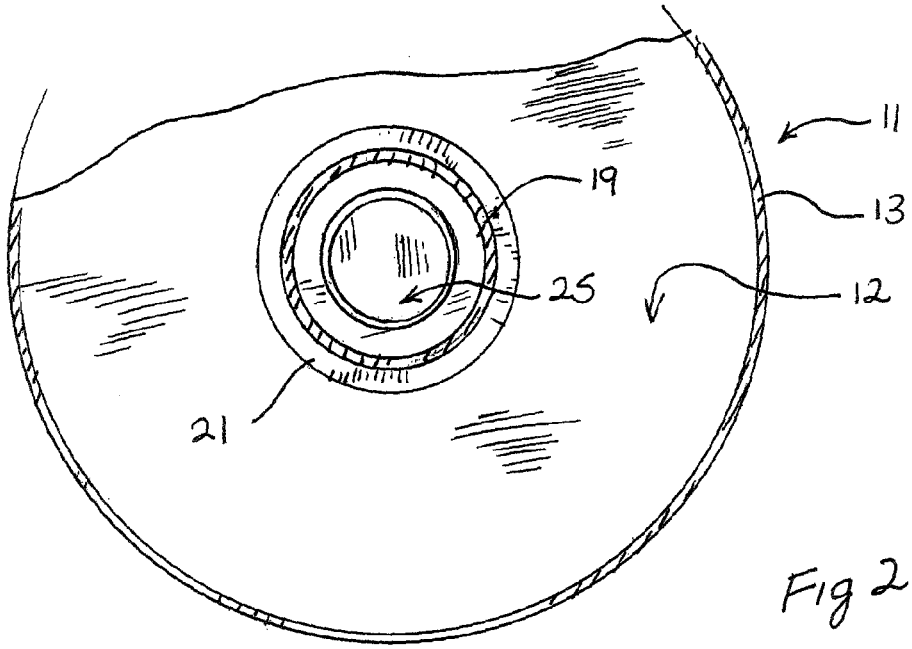
FIG. 2 is a cross-sectional view on lines 2-2 of FIG. 1.
Figure 3:
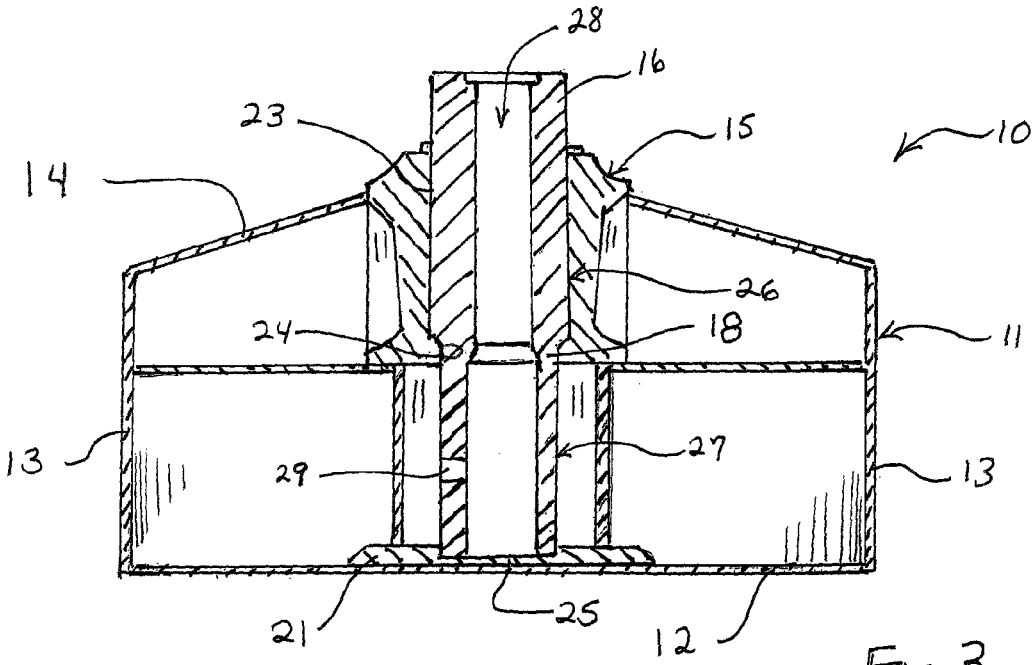
FIG. 3 is a cross-sectional view of the center support bearing assembly of the invention with a center pin positioned therewithin.

A dragline excavator center pin bearing support assembly 10 of the invention can be seen in FIGS. 1 and 2 of the drawings. The dragline center pin support assembly 10 has an annular pivot pin housing 11 which is positioned within a dragline excavator tub (not shown). The housing 11 has an annular base plate 12 with an upstanding perimeter annular sidewall 13. A top wall 14 extends from the sidewall 13 radially upwardly to a primary bearing fitting 15 in which a center pivot retention pin 16 extends as seen in FIG. 3 of the drawings.

The primary bearing fitting 15 has a center bore 17 therethrough with an upper pin receiving opening at 17A and a lower pin exit opening at 17B. The bearing fitting 15 has an area of reduced internal bore dimension at 18 adjacent the lower exit bearing opening 17B which will be described in greater detail hereinafter.

The bearing fitting 15 is positioned on and supported by an annular sleeve 19 with a horizontally extending stabilization frame plate 20 extending radially therefrom. The annular support sleeve 19 extends from and is supported by a raised central bearing platform 21 on the base plate 12 and is in vertical alignment with the hereinbefore described lower bore exit opening 17B.

The annular support sleeve 19 has multiple power line access openings at 22 annularly spaced thereabout as best seen in FIG. 1 of the drawings. The central bearing fitting 15 is preferably of a cast monolithic construction and defines two bearing guide engagement surfaces within the bore 17. The first bearing guide surface within the bore 17 is its interior annular wall surface 23 extending from the upper pin receiving opening at 17A.

A second bearing guide engagement surface 24 is defined by the hereinbefore described area of reduced interior bore diameter at 18.

It will be evident from the above description that as illustrated best in FIG. 3 of the drawings the center pivot retention pin 16 is engaged by the first bearing guide surface annular wall 23 therealong and the second bore guide engagement surface 24 adjacent thereto as noted.

Referring back now to FIG. 1 of the drawings the raised central bearing platform 21 is of a solid monolithic construction and has a central annular center pin receiving recess 25 therewithin which defines a stabilization bearing pocket for the base of the center pivot retaining pin 16. The center retaining pin 16 shown in this example is of a cast construction having an outer upper and lower bearing surfaces 26 and 27 respectively of different annular diameter. A bore at 28 extends longitudinally therethrough with at least one horizontally disposed opening at 29 extending through the lower surface 27.

It will be evident from the above description that the geometry of the center pivot retaining pin 16 defines that the upper and lower bearing surface portions 26 and 27 are of different wall thicknesses induced thereby. The center pin 16 provides a pivot access and retention for the dragline (not shown) to prevent unintended lateral movement thereof as will be well understood within the art. The base of the center pivot retaining pin 16 is registerably received within the recess 25 of the bearing platform 21 which in combination with the hereinbefore described first and second bearing surfaces in the primary bearing fitting 15 reduces extraneous wear and increases the working life of the assembly.

Figure 4:
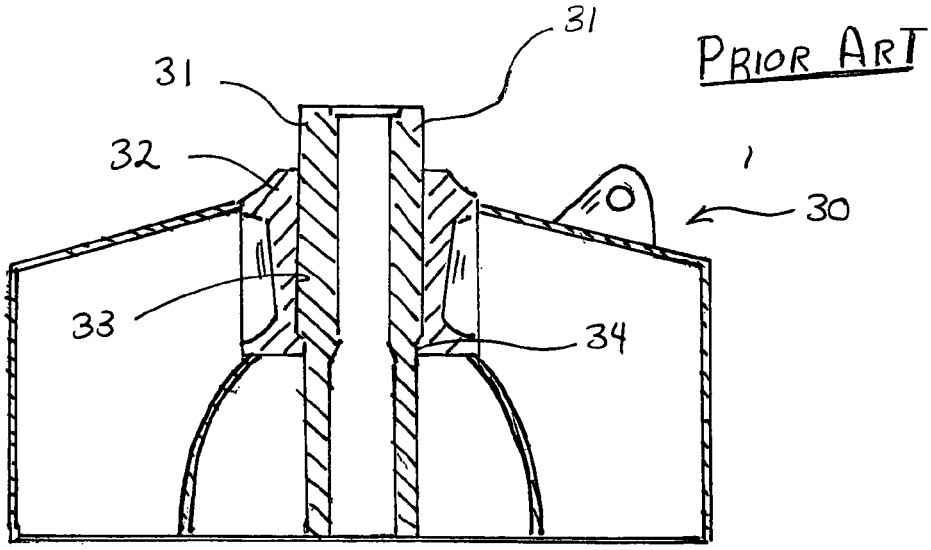
FIG. 4 is a cross-sectional view of a prior art center pin bearing bore assembly.

Comparison to prior art designs which can be seen in FIG. 4 of the drawings, prior art typically relies only on a center pin support assembly 30 having a prior art center pin 31 retained within a prior art center cast bearing fitting 32 defining two guide bearing surfaces 33 and 34 (bores) therewithin. The prior art pin 31 simply extends downwardly without any additional translateral support thus imparting additional wear and eventual failure to the limited prior art bearing surfaces of the central pin and support assembly 30.

If will therefore be evident that the present invention by having a central stabilization pin receiving bearing pocket recess 25 within the base plate 21 increases the useful product life of the assembly.

It will thus be seen that a new and improved center pin support bearing and guide fixture has been illustrated and described and it will be apparent to those skilled in the art that various changes and modifications may be made thereto without departing from the spirit of the invention.

Therefore we claim:

1. A center pin support for a walking dragline excavator comprises, a center pin receiving housing having a base plate, a primary bearing fitting centrally secured within said center pin receiving housing, a center pin receiving bore in said bearing fitting, an independent annular horizontally dipsosed bearing platform within said housing on said base plate in vertical spaced relation to said bearing fitting, a bearing fitting support sleeve extending between said bearing fitting and said bearing platform, an annular recess in said bearing platform aligned with said center pin receiving bore, a center pin registerable within said center pin receiving bore and said annular recess in said bearing platform, a first and second bearing pin surface within said bearing fitting.

2. The center pin support for a walking dragline excavator of claim 1 wherein said first bearing pin surface comprises, the inside bore surface of said bearing fitting.

3. The center pin support for a walking dragline excavator set forth in claim 1 wherein said second bearing pin surface comprises, an area of reduced annular bore dimension within said bearing fitting.

4. The center pin support for a walking dragline excavator set forth in claim 1 wherein said center pin receiving housing comprises, said base plate, an upstanding annular sidewall extending therefrom, a top wall extending from said sidewall to said bearing fitting supported therewithin, a horizontal stabilizer frame plate extending from said center pin receiving housing and in contrast with said primary bearing fitting.

5. The center pin support for a walking dragline excavator set forth in claim 1 wherein said primary bearing fitting has a tapered exterior annular wall surface defining area of reduced wall thickness adjacent said second bearing surface therewithin.

6. The center pin support for a walking dragline excavator set forth in claim 1 wherein said bearing fitting support sleeve is of a known diameter less than that of said bearing fitting at a point of engagement therewith.

7. The center pin support for a walking dragline excavator set forth in claim 1 wherein said bearing fitting support sleeve has at least one access opening therewithin.

* * * * *